US005330368A

United States Patent [19]

Tsuruzono

[11] Patent Number: 5,330,368

[45] Date of Patent: Jul. 19, 1994

[54] APPARATUS FOR LIGHTING BASELESS BULBS

[76] Inventor: Masaaki Tsuruzono, 1-18-1, Yazaike, Adachi-ku, Tokyo, Japan

[21] Appl. No.: 936,522

[22] Filed: Aug. 28, 1993

[30] Foreign Application Priority Data

Feb. 7, 1992 [JP] Japan ..... 4-56814

[51] Int. Cl.[5] ..... H01R 4/24

[52] U.S. Cl. ..... 439/409; 439/419; 362/226; 362/249; 362/391

[58] Field of Search ..... 439/395, 409, 410, 419, 439/425; 362/249, 226, 227, 252, 391, 806

[56] References Cited

U.S. PATENT DOCUMENTS

| | | | |
|---|---|---|---|
| 2,963,572 | 12/1960 | Rullo | 362/249 |
| 4,234,915 | 11/1980 | Malinowski et al. | 362/391 |
| 4,514,791 | 4/1985 | Tokieda | 362/391 |
| 4,631,650 | 12/1986 | Ahroni | 362/249 |
| 4,667,276 | 5/1987 | Cheng | 362/249 |
| 5,109,324 | 4/1992 | Ahroni | 362/249 |

FOREIGN PATENT DOCUMENTS

| | | | |
|---|---|---|---|
| 42682 | 4/1977 | Japan | 362/219 |
| 111979 | 4/1989 | Taiwan . | |

*Primary Examiner*—Ira S. Lazarus
*Assistant Examiner*—Alan B. Cariaso
*Attorney, Agent, or Firm*—Spencer, Frank & Schneider

[57] ABSTRACT

A flat bundle of cables are each sheathed with an electrically insulative synthetic resin and arranged in a spaced relationship while extending in parallel with each other. A plurality of baseless bulbs are arranged one after another along at least one cable of the flat bundle of cables while making electrical connection to the at least one cable via lead wires. A plurality of moldable plastic material holding structures are arranged one after another in the spaced relationship along the flat bundle of cables. Each holding structure serves to firmly hold a respective baseless bulb and the flat bundle of cables so that a central axis of the bulb extends parallel with a plane of the flat bundle of cables and perpendicular to the extending direction of the cables.

8 Claims, 11 Drawing Sheets

APPARATUS FOR LIGHTING BASELESS BULBS

BACKGROUND OF THE INVENTION

1. Field of the Invention

The present invention relates generally to an apparatus for lighting a number of baseless bulbs for the purpose of decoration. More particularly, the present invention relates to an apparatus for lighting a number of baseless bulbs for the purpose of decoration wherein a plurality of baseless bulbs arranged on a flat bundle of cables are lighted continuously or intermittently as desired, in accordance with the order that the baseless bulbs are arranged one after another along each array of baseless bulbs. Further, the present invention relates to a socket or a bulb mounting/connecting body preferably employable for the apparatus of the foregoing type wherein a flat bundle of cables is firmly held in the socket in the clamped state.

2. Description of the Related Art

As is well known, to increase a decorative effect in a Christmas season or for the purpose of window-displaying in a shopping district, a number of bulbs are arranged over a plane in individual shop and they are lighted continuously or intermittently as desired. Many proposals have been hitherto made with respect to an apparatus for lighting bulbs.

In view of storage of the apparatus in a small space during an inoperative period of time and simplification of practical use, baseless bulbs are usually used for the apparatus and they are electrically connected to cables via lead wires by soldering or caulking.

When the apparatus is constructed with a number of baseless bulbs, it exhibits advantages that it can be stored in a small space and it can be fabricated at a reduced cost. However, since it is difficult to automatically connect lead wires to each cable by soldering or caulking, each connecting operation should unavoidably be performed with operator's hands. For this reason, this type of conventional apparatuses cannot be fabricated on a mass production line in spite of a large demand for them.

Another problem of the conventional apparatus is that a mode of operation of the apparatus, i.e., continuous lighting or intermittent lighting of the same can be changed only in strictly limited circumstances.

Accordingly, there is still left plenty of room for improvement in respect to wiring operations, decorative effects, cable holding members and variation of the lighted state.

SUMMARY OF THE INVENTION

The present invention has been made in consideration of the foregoing background.

An object of the present invention is to provide an apparatus for continuously or intermittently lighting a number of baseless bulbs for the purpose of decoration wherein the apparatus can simply be used with a small storage space.

Another object of the present invention is to provide an apparatus for continuously or intermittently lighting a number of baseless bulbs for the purpose of decoration wherein a decorative effect derived from the apparatus can be increased substantially.

Further object of the present invention is to provide an apparatus for continuously or intermittently lighting a number of baseless bulbs for the purpose of decoration wherein the available number of baseless bulbs can be increased.

Still further object of the present invention is to provide a socket preferably employable for the apparatus of the foregoing type wherein a wiring operation can easily be performed for the apparatus without any necessity for soldering, caulking or the like.

The present invention provide an apparatus for lighting a number of baseless bulbs for the purpose of decoration, wherein the apparatus comprises a flat bundle of cables each sheathed with an electrically insulative synthetic resin and arranged in the spaced relationship while extending in parallel with each other; a plurality of baseless bulbs arranged one after another along at least one cable of the flat bundle of cables while making electrical connection to at least one cable via lead wires; and a plurality of holding means each serving to firmly hold a baseless bulb and the flat bundle of cables, each of the plurality of holding means being arranged one after another in the spaced relationship along the flat bundle of cables.

It is preferable that each holding means is prepared in the form of a socket wherein the socket comprises a main body molded of a flexible elastic synthetic resin and comprising a first half and a second half jointed to each other via a folding portion interposed therebetween, the first half and the second half being integrated with each other in the face-to-face relationship by folding the second half along the folding portion when the apparatus is practically used; a first clamping wall formed on the first half for firmly holding the base portion of a baseless bulb in the clamped state when both the halves are integrated with each other for practical use in the face-to-face relationship, the first clamp wall being contoured to exhibit a semicylindrical shape corresponding to the base portion of the baseless bulb; a second clamp wall formed on the first half for firmly receiving a plurality of transversely extending cables constituting a flat bundle of cables in the clamped state when both the halves are integrated with each other for practical use in the face-to-face relationship, the second clamping wall being contoured to exhibit a corrugated wall surface consisting of a plurality of transversely extending semicylindrical cable receiving grooves corresponding to the plurality of transversely extending cables; a first clamping wall formed on the second half for firmly holding the base portion of the baseless bulb in the clamped state in cooperation with the first clamp wall on the first half when both the halves are integrated with each other for practical use in the face-to-face relationship, the first clamp wall being contoured to exhibit a semicylindrical shape corresponding to the base portion of the baseless bulb; a second clamp wall formed on the second half for firmly receiving the plurality of transversely extending cables constituting the flat bundle of cables in the clamped state in cooperation with the second clamp wall on the first half when both the halves are integrated with each other for practical use in the face-to-face relationship, the second clamp wall being contoured to exhibit a corrugated wall surface consisting of a plurality of transversely extending semicylindrical cable receiving grooves corresponding to the plurality of transversely extending cables; and at least two selective contact pieces fitted into the first clamp wall formed on the first half for firmly receiving the transversely extending cables in the clamped state while extending at a right angle relative to the transversely extending cables, one of the selective contact pieces being electrically connected to one of lead wires extending from the baseless bulb by receiving it in a V-shaped groove formed on a projected part thereof, and moreover, electrically connected to one cable selected from the plurality of transversely extending cables via a piercer projecting therefrom and pierced into the selected cable, whereas the other one having a length different from that of the first-mentioned selective contact piece and being electrically connected to the other lead wire extending from the baseless bulb by receiving it in a V-shaped groove formed on a projected part thereof, and moreover, electrically connected to other cable selected from the plurality of transversely extending cables via a piercer projecting therefrom and pierced into the selected other cable.

To assure that both the halves are correctly integrated with each other in the face-to-face relationship, small column-shaped projection are caused to stand upright on the first half and holes are formed in the second half at the positions corresponding to the projection so as to receive them therein when both the halves are integrated with each other for practical use in the face-to-face relationship.

It is desirable that the second half includes projected banks for retaining the lead wires extending from the baseless bulb when both the halves are integrated with each other for practical use in the face-to-face relationship.

Further, it is desirable that the second half includes a restrictive wall for restrictively determining the position where the baseless bulb is firmly held between both the halves in the clamped state when both the halves are integrated with each other for practical use in the face-to-face relationship.

Alternatively, the socket may be constructed in a modified manner. Specifically, the socket comprises a main body molded of a flexible elastic synthetic resin and comprising a first half and a second half jointed to each other via a folding portion interposed therebetween, the first half and the second half being integrated with each other in the face-to-face relationship by folding the second half along the folding portion when the apparatus is practically used; a first clamp wall formed on the first half for firmly holding the base portion of a baseless bulb in the clamped state when both the halves are integrated with each other for practical use in the face-to-face relationship, the first clamp wall being contoured to exhibit a semicylindrical shape corresponding to the base portion of the baseless bulb; a second clamp wall formed on the first half for firmly receiving a plurality of transversely extending cables constituting a flat bundle of cables in the clamped state when both the halves are integrated with each other for practical use in the face-to-face relationship, the second clamp wall being contoured to exhibit a corrugated wall surface consisting of a plurality of transversely extending semicylindrical cable receiving grooves corresponding to the plurality of transversely extending cables; a first longitudinally extending groove formed on the first half while extending from the first clamp wall formed for firmly holding the base portion of the baseless bulb to a predetermined position substantially corresponding to one cable selected from the plurality of transversely extending cables, the first longitudinally extending groove serving to allow one of lead wires extending from the baseless bulb to extend therethrough to be electrically connected to the one selected cable; a second longitudinally extending groove having a length different from that of the first longitudinally extending groove and formed on the first half while extending from the first clamp wall formed for firmly holding the base portion of the baseless bulb to a predetermined position substantially corresponding to other cable selected from the plurality of transversely extending cables, the second longitudinally extending groove serving to allow the other lead wire extending from the baseless bulb to extend therethrough to be electrically connected to the other selected cable; a plurality of short transversely extending grooves formed corresponding to the semicylindrical cable receiving grooves so as to allow the foremost end parts of the lead wires to be received therein in the bent state; a first clamp wall formed on the second half for firmly holding the base portion of the baseless bulb in the clamped state in cooperation with the first clamp wall on the first half when both the halves are integrated with each other for practical use in the face-to-face relationship, the first clamp wall being contoured to exhibit a semicylindrical shape corresponding to the base portion of the baseless bulb; a second clamp wall formed on the second half for firmly receiving the plurality of transversely extending cables constituting the flat bundle of cables in the clamped state in cooperation with the second clamp wall on the first half when both the halves are integrated with each other for practical use in the face-to-face relationship, the second clamp wall being contoured to exhibit a corrugated wall surface consisting of a plurality of transversely extending semicylindrical cable receiving grooves corresponding to the plurality of transversely extending cables; at least two selective contact pieces fitted into the first clamp wall formed on the first half for firmly receiving the plurality of transversely extending cables in the clamped state while extending in parallel with the transversely extending semicylindrical cable receiving grooves, one of the selective contact pieces being located in one predetermined transversely extending semicylindrical cable receiving groove and electrically connected to one of the lead wires extending from the baseless bulb by receiving it in a V-shaped groove formed on a projected part thereof, and moreover, electrically connected to one cable selected from the plurality of transversely extending cables via piercers projecting therefrom and pierced into the selected one cable, whereas the other one being located in other predetermined transversely extending semicylindrical cable receiving groove and electrically connected to the other lead wire extending from the baseless bulb by receiving it in a V-shaped groove formed on a projected part thereof, and moreover, electrically connected to other cable selected from the plurality of transversely extending cables via piercers projecting therefrom and pierced into the selected other cable.

In addition, the socket may be constructed in another modified manner. Specifically, the socket comprises a main body molded of a flexible elastic synthetic resin and comprising a first half and a second half jointed to each other via a folding portion interposed therebetween, the first half and the second half being integrated with each other in the face-to-face relationship by folding the second half along the folding portion when the apparatus is practically used; a first clamp wall formed on the first half for firmly holding the base portion of a baseless bulb in the clamped state when both the halves are integrated with each other for practical use in the face-to-face relationship, the first clamp wall being contoured to exhibit a semicylindrical shape corresponding to the base portion of the baseless bulb; a second clamp wall formed on the first half for firmly receiving a plurality of transversely extending cables constituting a flat bundle of cables in the clamped state when both the halves are integrated with each other for practical use in the face-to-face relationship, the second clamp wall being contoured to exhibit a corrugated wall surface consisting of a plurality of transversely extending semicylindrical cable receiving grooves corresponding to the plurality of transversely extending cables; two longitudinally extending grooves formed on the first half while extending in parallel with each other from the first clamp wall formed for firmly holding the base portion of the baseless bulb to a predetermined position substantially corresponding to the inner end of the corrugated wall surface of the first clamp wall, the longitudinally extending grooves serving to allow lead wires extending from the baseless bulb to extend therethrough to be electrically connected to a predetermined cable selected from the plurality of transversely extending cables; a plurality of short transversely extending grooves formed corresponding to the semicylindrical cable receiving grooves so as to allow the foremost end parts of the lead wires to be received therein in the bent state; a first clamp wall formed on the second half for firmly holding the base portion of the baseless bulb in the clamped state in cooperation with the first clamp wall on the first half when both the halves are integrated with each other for practical use in the face-to-face relationship, the first clamp wall being contoured to exhibit a semicylindrical shape corresponding to the base portion of the baseless bulb; a second clamp wall formed on the second half for firmly receiving the plurality of transversely extending cables constituting the flat bundle of cables in the clamped state in cooperation with the second clamp wall on the first half when both the halves are integrated with each other for practical use in the face-to-face relationship, the second clamp wall being contoured to exhibit a corrugated wall surface consisting of a plurality of transversely extending semicylindrical cable receiving grooves corresponding to the plurality of transversely extending cables; and at least two selective contact pieces fitted into the first clamp wall formed on the first half for firmly receiving the plurality of transversely extending cables in the clamped state while extending in parallel with the transversely extending semicylindrical cable receiving grooves, the selective contact pieces being located in a predetermined transversely extending semicylindrical cable receiving groove in alignment with each other in the transverse direction and electrically connected to the lead wires extending from the baseless bulb by receiving them in V-shaped grooves formed on projected parts thereof, and moreover, electrically connected to the predetermined cable via piercers projected therefrom and pierced into the predetermined cable.

Other objects, features and advantages of the present invention will become apparent from reading of the following description which has been made in conjunction with the following drawings.

BRIEF DESCRIPTION OF THE DRAWINGS

The present invention is illustrated in the following drawings in which:

FIG. 5(*b*) is a plan view of the socket shown in FIG. 5(*a*);

FIG. 5(*c*) is a front view of the socket shown in FIG. 5(*a*);

FIG. 12(*b*) is a plan view of the socket shown in FIG. 12(*a*);

FIG. 12(*c*) is a front view of the socket shown in FIG. 12(*a*);

FIG. 15(*b*) is a plan view of the socket shown in FIG. 15(*a*);

FIG. 15(*c*) is a front view of the socket shown in FIG. 15(*a*);

FIG. 17(*b*) is a front view of the selective contact piece shown in FIG. 17(*a*)

DESCRIPTION OF THE PREFERRED EMBODIMENTS

The present invention will now be described below with reference to the accompanying drawings which illustrate preferred embodiments thereof.

FIG. 1 to FIG. 4 are illustrative views each of which schematically shows the structure of a first to forth example; a bulb illuminating circuit used for an apparatus for lighting a number of baseless bulbs for the purpose of decoration according to the present invention. The circuit includes a flat bundle of cables $l_1$, $l_2$,—$l_m$ each electrically insulatively sheathed with a polyvinyl chloride resin and flatly arranged in a spaced relationship while extending in parallel with each other (hereinafter referred to simply as a flat cable) and an array or plurality and of baseless bulbs (each hereinafter referred to simply as a bulb) $P_1$, $P_2$,—$P_n$.

Figure 1:
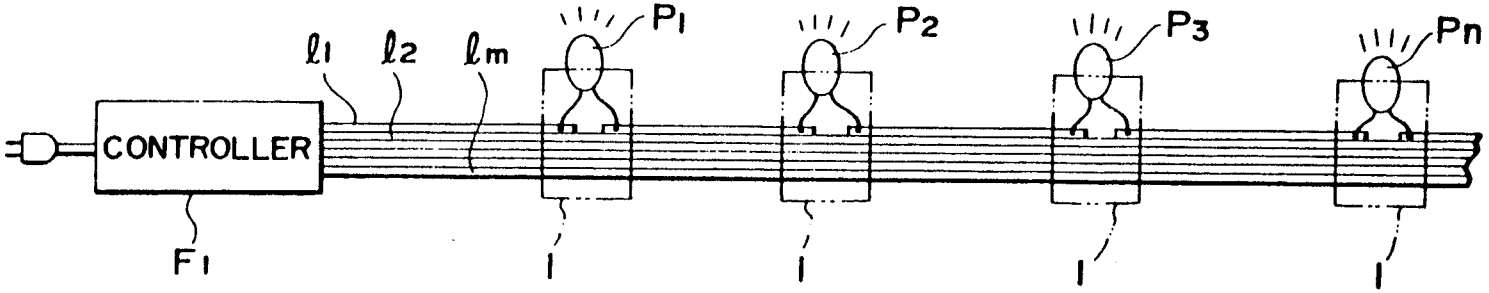
FIG. 1 is an illustrative view which schematically shows the structure of a first example of an illuminating circuit used for an apparatus for lighting a number of baseless bulbs for the purpose of decoration according to the present invention.

In addition, the includes a block circuit $F_1$ for dividing AC input from a commercial power source into respective cables $l_1$, $l_2$,—$l_m$ in the flat cable (see FIG. 1). As desired, the circuit may include a flash controlling circuit $F_2$ for intermittently feeding AC to respective bulbs with certain differential time between adjacent bulbs (see FIG. 2). Alternatively, the circuit is constructed such that an AC voltage is reduced with the aid of a transformer T, and AC having the thus reduced voltage is then rectified in a rectifier (not shown) to generate a DC voltage which in turn is fed to respective bulbs via a flash controlling circuit $F_3$ (see FIG. 3 and FIG. 4).

With the circuit constructed as shown in FIG. 1 so as to allow it to operate directly with the commercial power source (AC power source), a number of bulbs $P_1$, $P_2$,—$P_n$ are arranged one after another along a single cable (e.g., cable l1) in the flat cable wherein the number of bulbs $P_1$, $P_2$,—$P_n$ is determined such that a total sum of rated voltages specified for the respective bulbs is substantially equal to a voltage of the commercial supply source.

Specifically, lead wires extending from the respective bulbs $P_1$, $P_2$,—$P_n$ are connected to one of the cables $l_1$, $l_2$,—$l_m$ with a predetermined distance between adjacent bulbs. It should be noted that a part of the cable to which the bulbs $P_1$, $P_2$,—$P_n$ are successively connected is cut and not shown off (see FIG. 1 and FIG. 2). With this construction, the respective bulbs $P_1$, $P_2$,—$P_n$ are electrically connected to each other in series.

In case that the circuit is constructed with the block circuit $F_1$ in such a manner as shown in FIG. 1, the number ($n \times m$) of bulbs can be lighted with the circuit by feeding AC to them from the commercial power source via the block circuit $F_1$ wherein the foregoing number of $n \times m$ is derived from multiplication of the number of cables (m) $L_1$, $L_2$,—$l_m$ by the number of bulbs (n) $P_1$, $P_2$,—$P_n$.

In case that AC is intermittently fed to the respective cables $l_1$, $l_2$,—$l_m$ with differential time between adjacent cables via the flash controlling circuit $F_2$, the respective bulbs $P_1$, $P_2$,—$P_n$ successively connected to the corresponding cables are lighted with lighting time differing from each other. In this case, illuminated points generated by the respective bulbs $P_1$, $P_2$,—$P_n$ are sequentially visually recognized in accordance with the order that they are successively connected to the cables $l_1$, $l_2$,—$l_m$ as shown in FIG. 2 as if they flow downstream of the flash controlling circuit $F_2$, i.e. in the arrow-marked direction.

Figure 3:
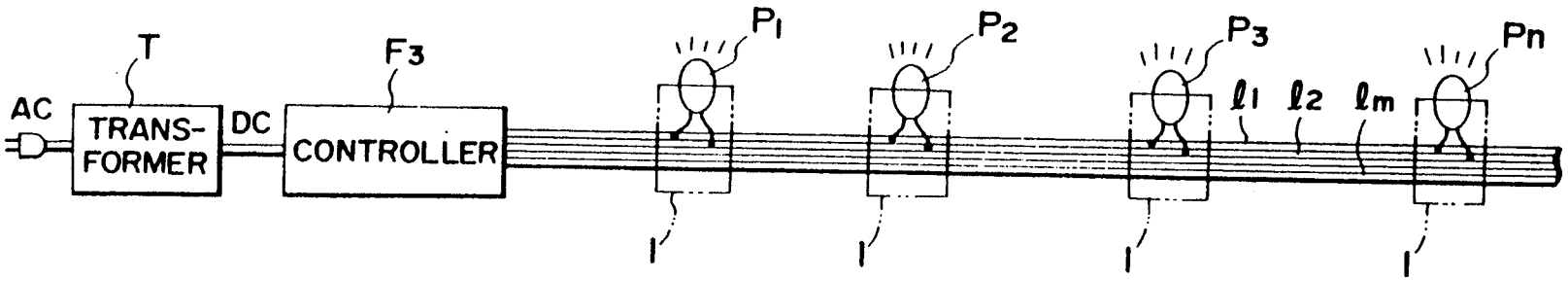
FIG. 3 is an illustrative view which schematically shows the structure of a third example of an illuminating circuit used for an apparatus for lighting a number of baseless bulbs for the purpose of decoration according to the present invention.
Figure 4:
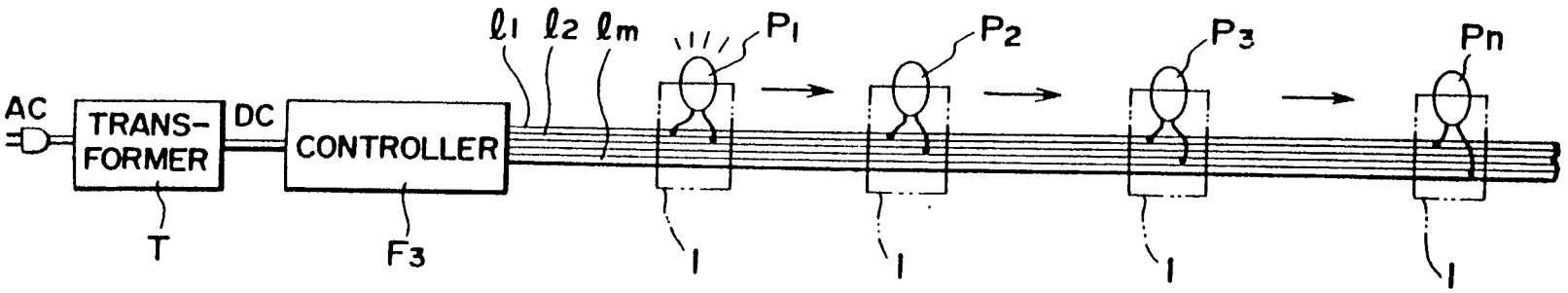
FIG. 4 is an illustrative view which schematically shows the structure of a fourth example of an illuminating circuit used for an apparatus for lighting a number of baseless bulbs for the purpose of decoration according to the present invention.

When it is required that the number of available bulbs increases, it is recommendable to construct the circuit as shown in FIG. 3 and FIG. 4. In this case, when it is assumed that a bulb having ratings of 28 V and 40 mA is employed for the bulbs $P_1$, $P_2$,—$P_n$, AC from the commercial power source is converted via the transformer. T into DC of 24 V and several amperes which in turn is fed to the respective cables $l_1$, $l_2$,—$l_m$ as shown in FIG. 3 and FIG. 4. In addition, when feeding of the thus rectified DC is intermittently controlled by the flash controlling circuit $F_3$, an array of bulbs $P_1$, $P_2$,—$P_n$ are intermittently lighted since lead wires extending from each bulb are bridged between two adjacent cables among the respective cables $l_1$, $l_2$,—$l_m$ for making electrical connection therebetween. Alternatively, lead wires may be bridged between the cable $l_1$ and one of the other cables $l_2$,—$l_m$ wherein the cable $l_1$ serves as a common cable as shown in FIG. 4. In this case, the number of available bulbs is a certain number which is in the range determined by an electric current capacity of the transformer T.

Figure 2:
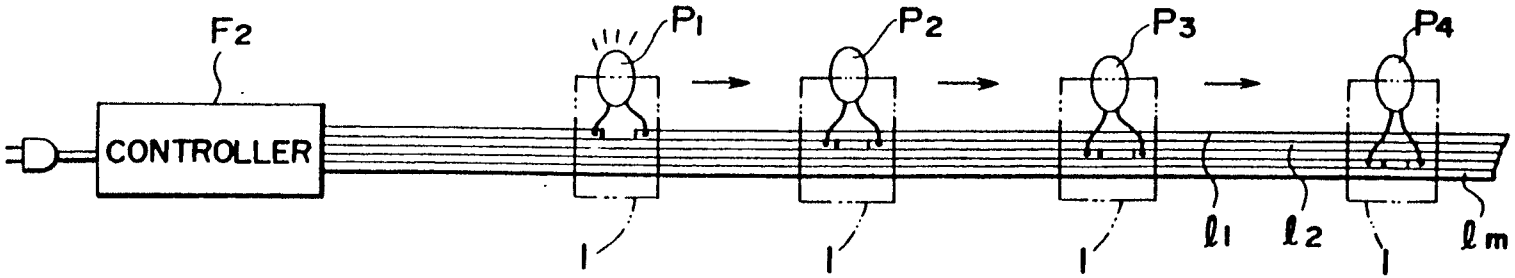
FIG. 2 is an illustrative view which schematically shows the structure of a second example of an illuminating circuit used for an apparatus for lighting a number of baseless bulbs for the purpose of decoration according to the present invention.

When bulbs $P_1$, $P_2$,—$P_n$ are arranged such that lead wires extending from each of them are bridged between an adjacent two cables and electrical connection of the respective bulbs to each other is successively made in that way, a flow of illuminated points can visually be recognized in the same manner as the case shown in FIG. 2.

Figure 5A:
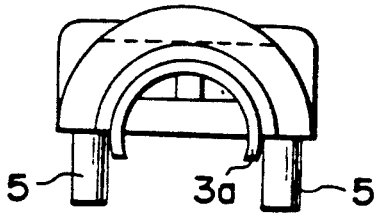
FIG. 5(*a*) is a rear view of a first embodiment of a socket used for the bulb lighting apparatus of the present invention.
Figure 5B:
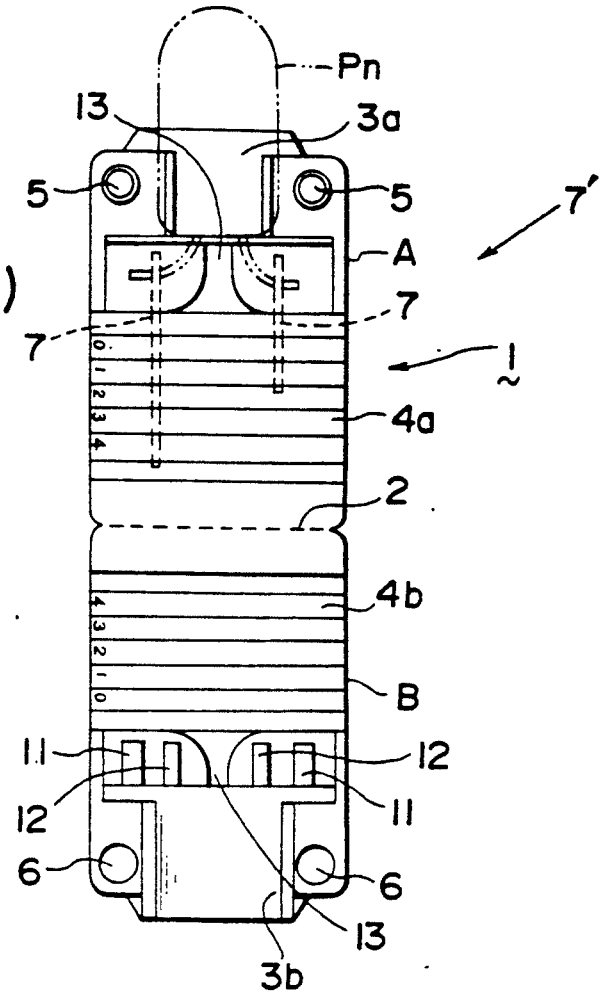
Figure 5C:
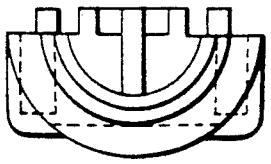
Figure 18:
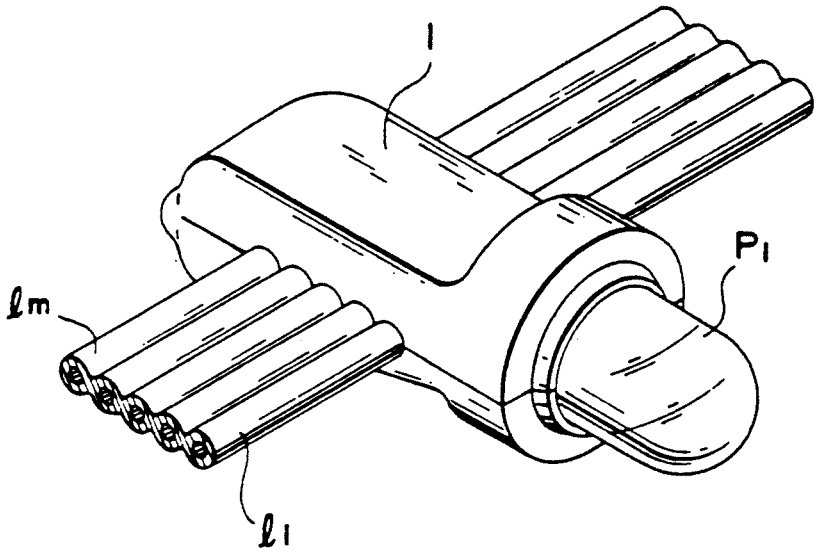
FIG. 18 is a perspective view of the bulb lighting apparatus exemplified in FIGS. 5(*a*), 5(*b*) and 5(*c*).

Next, FIGS. 5(*a*), 5(*b*) and 5(*c*) show a socket in accordance with a first embodiment of the present invention wherein the socket is employable for any one of the circuits shown in FIG. 1 to FIG. 4, and FIG. 6 is a side view of the socket shown in FIGS. 5(*a*), 5(*b*) and 5(*c*). It should be noted that the completely assembled state of the socket having a flat cable held therein the clamped state is shown in FIG. 18.

A main body 1 of the socket is molded of a flexible elastic synthetic resin, such as polypropylene or the like, and comprises two halves A and B which can be folded along a folding portion 2 to build an integral structure in a face-to-face relationship.

The halves A and B include clamping walls 3*a* and 3*b* for forming a hollow space for holding the base portion of a bulb $P_n$ in the clamped state when they are integrated with each other in the face-to-face relationship by folding them along the folding portion 2. In addition, they include clamping walls 4*a* and 4*b* for forming a hollow space for holding respective cables $l_1$, $l_2$,—$l_m$ in the clamped state when they are integrated with each other in the same manner as mentioned above. As is best seen in FIG. 6, an outer wall surface of each of the clamp walls 4*a* and 4*b* exhibits a corrugated contour consisting of a plurality of semicircles (grooves) corresponding to the outer shape of each cable, in order to assure that the respective cables $l_1$, $l_2$,—$l_m$ are firmly arranged in position on the flat cable while extending in the transverse direction.

The half A includes small column-shaped projections 5 at its free end, while the half B has holes 6 formed at its free end so as to receive the projections 5 on the half A. When both the halves A and B are integrated with each other in the face-to-face relationship by folding them along the folding portion 2, the projections 5 are fitted into the corresponding holes 6 with frictional contact therebetween. This frictional contact reliably prevents the projections 5 from being disconnected from a holes 6 while the vacuum action appearing at the bottom of each hole 6 is added to the foregoing frictional contact. Thus, the integrated state of both the halves A and B can reliably be maintained.

Figure 6:
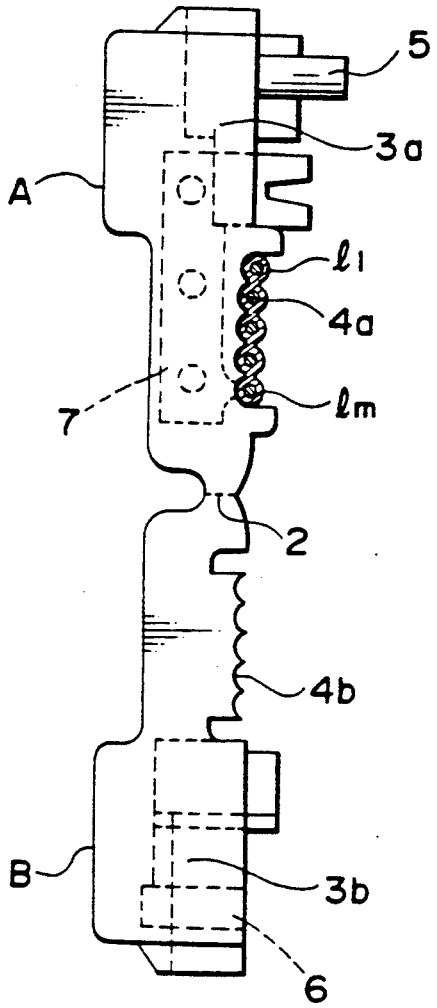
FIG. 6 is a side view of the socket shown in FIGS. 5(*a*), 5(*b*) and 5(*c*)
Figure 7:
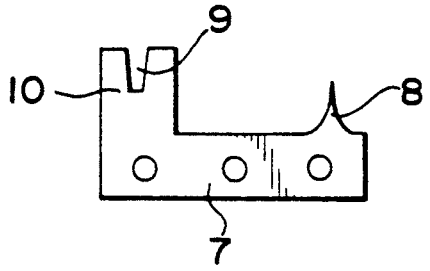
FIG. 7 is a side view of a selective contact piece for the socket shown in FIGS. 5(*a*), 5(*b*), 5(*c*) and FIG. 6.
Figure 8:
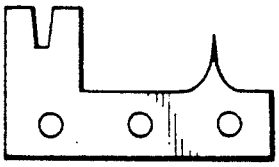
FIG. 8 is a side view of other selective contact piece for the same having a length different from that of the selective contact piece shown in FIG. 7.
Figure 9:
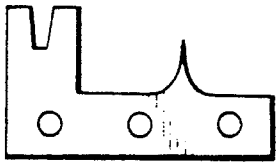
FIG. 9 is a side view of another selective contact piece for the same having a length different from that of the comparative contact piece shown in FIG. 7.
Figure 10:
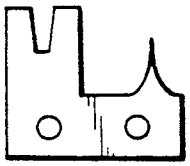
FIG. 10 is a side view of further selective contact piece for the same having a length different from that of the selective contact piece shown in FIG. 7.
Figure 11:
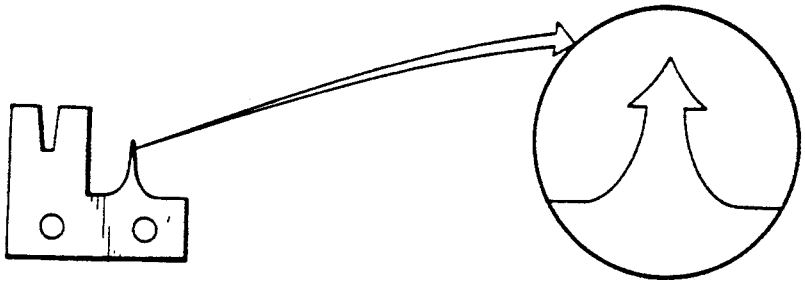
FIG. 11 is a side view of further another selective contact piece for the same having a length different from that of the comparative contact piece shown in FIG. 7.

As represented by dotted lines in FIG. 5(*b*) and FIG. 6, a pair of selective contact pieces 7 and 7' are arranged in the hollow space on the half A at a right angle relative to the cables $l_1$, $l_2$,—$l_m$ extending in the transverse direction while their piercers 8 are projected slightly outward of the corrugated surface of the clamping wall 4 (see e.g. FIG. 7). The arrangement of the selective contact pieces 7 and 7' in that way is achieved by actuating embedding means or striking means (not shown).

Each of the selective contact pieces 7 and 7' can be constructed in several ways as shown in FIG. 7 to FIG. 11. Specifically, they can have different lengths as measured from the piercer 8 to a projected part 10 which has a V-shaped groove 9 formed therein to firmly hold a lead wire. This is intended to determine a position to be assumed by each of the cables $l_1$, $l_2$,—$l_m$ depending on the foregoing different length.

In FIG. 5(*b*), reference numerals 11 and 12 designate projected banks on the half B which serve as lead wire retainers arranged at the opposite positions to the selective contact pieces 7 on the half A, and reference numeral 13 designates a restrictive wall for restrictively determining the position where each bulb $P_n$ is firmly held.

Next, a mode of practical use of the socket constructed in the aforementioned manner will be described below.

First, a bulb $P_n$ is placed on the clamp wall 3*a* of the half A which is held in the opened state, and lead wires extending from the bulb $P_n$ are then put in the V-shaped grooves 9 on the projected parts 10 projecting from the selective contact pieces 7 and 7'. Subsequently, both the halves A and B are integrated with each other in the face-to-face relationship by folding the half B along the folding portion 2 in such a manner that the flat cable comes in contact with the clamp wall 4*a* in cooperation with the clamp wall 4*b*. At this time, the projections 5 are firmly fitted into the holes 6, and the bulb Pn is held between both the clamp walls 3*a* and 3*b* in the clamped state. While the flat cable is firmly clamped between both the clamp walls 4*a* and 4*b*, the piercers 8 projecting slightly outward of the corrugated surface of the clamping wall 4*a* pierce into predetermined cables.

Since the lead wires received in the V-shaped grooves 9 on the selective clamp pieces 7 and 7' are squeezed further toward the bottom of each groove 9 by the projected banks 11 and 12 when both the halves A and B are integrated with each other in the face-to-face relationship as mentioned above, electrical connection is more reliably made between the piercers 8 and the cables while preventing the lead wires from being disengaged from the V-shaped grooves 9.

Thus, each bulb $P_n$ is firmly mechanically held relative to the cables while establishing electrical connection therebetween with the aid of the piercers 8 on the selective contact pieces 7 and 7'.

Figure 12A:
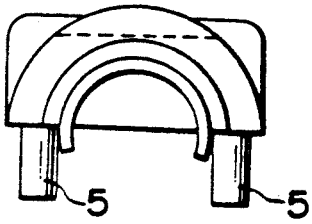
FIG. 12(*a*) is a rear view of a second embodiment of a socket used for the bulb lighting apparatus of the present invention.
Figure 12B:
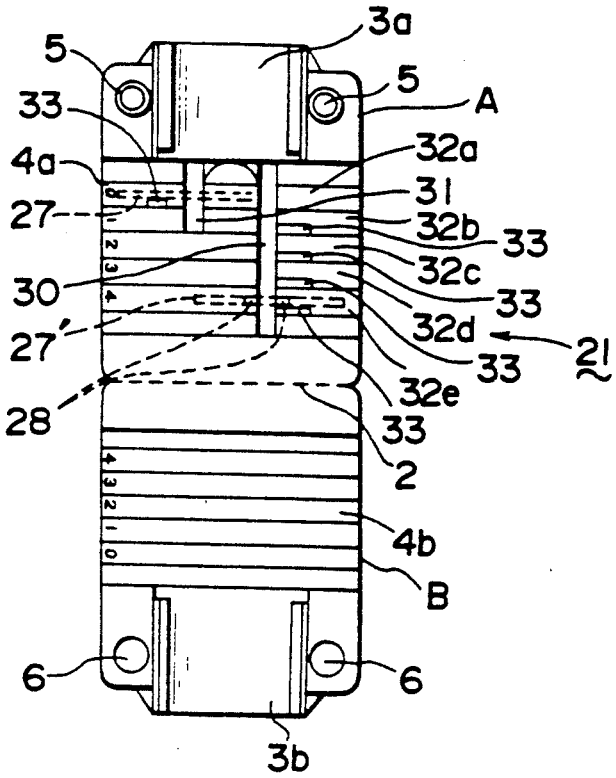
Figure 12C:
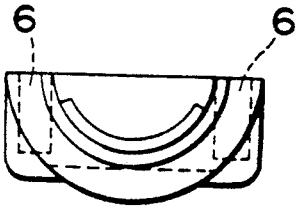
Figure 13:
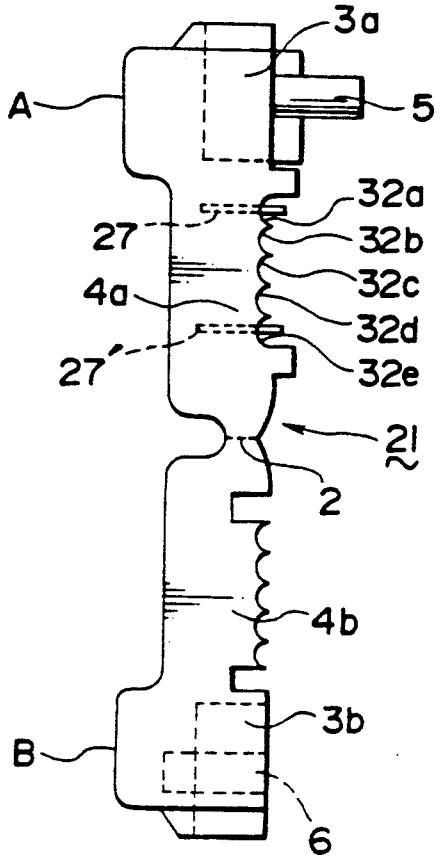
FIG. 13 is a side view of the socket shown in FIGS. 12(*a*), 12(*b*) and 12(*c*)

Next, FIGS. 12(*a*), 12(*b*) and 12(*c*) show a socket in accordance with a second embodiment of the present invention wherein the socket is employable for any one of the circuits shown in FIG. 1 to FIG. 4, and FIG. 13 is a side view of the socket shown in FIG. 12(*b*). It should be noted that the socket is preferably employable in case that the circuit operates with DC fed from a commercial power source via a transformer and a flash controlling circuit as shown in FIG. 3 and FIG. 4. A main body 21 of the socket comprising two halves A and B each foldable along a folding portion 2 is molded of a flexible elastic synthetic resin in the same manner as the preceding embodiment. Same parts or components as those shown in FIGS. 5(*a*), 5(*b*), 5(*c*) and FIG. 6 are represented by same reference numerals in FIGS. 12(*a*), 12(*b*), 12(*c*) and FIG. 13.

In this embodiment, clamp walls 4*a* and 4*b* are formed on both the halves A and B to firmly clamp a flat bundle of cables consisting of five cables placed in the transverse direction therebetween. To receive the respective cables, grooves 32*a*, 32*b*, 32*c*, 32*d* and 32*e* each having a semicircular sectional contour are formed on the clamp walls 4*a* and 4*b* corresponding to the respective cables. Among the five cables, a common cable is received in the groove 32*a*. In contrast with the preceding embodiment, in this embodiment, a pair of selective contact pieces 27 and 27' are fitted into the half A while extending in the transverse direction, i.e., in parallel with the grooves 32*a* to 32*e* so that they are selectively engaged with the common cable received in the groove 32*a* and one of the other cables received in the grooves 32*b* to 32*e*. Specifically, the selective contact pieces 27 and 27' are shown engaged with the cables received in the grooves 32*a* and 32*e*.

Figure 14:
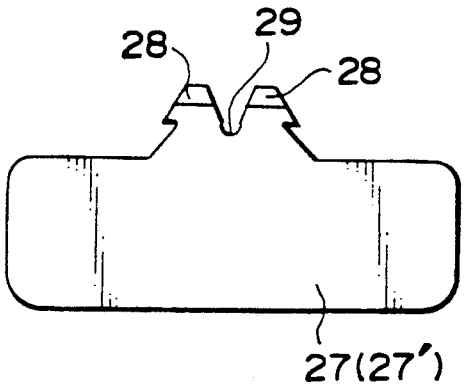
FIG. 14 is a side view of a selective contact piece for the socket shown in FIGS. 12(*a*), 12(*b*), 12(*c*) and FIG. 13.

FIG. 14 is a side view of each of the selective contact pieces 27 and 27'. Each selective contact piece is made of an electrically conductive metallic material, and piercers 28 are projected therefrom with a V-shaped groove 29 having a semicircular bottom formed therebetween to receive a lead wire extending from a baseless bulb (not shown).

Referring to FIGS. 12(*a*), 12(*b*) and 12(*c*) again, a longitudinally extending groove 31 is formed on the clamp wall 4*a* while extending from the clamp wall 3*a* to the groove 32*a* corresponding to the V-shaped groove 29 on the selective contact piece 27, while a longitudinally extending groove 30 having a length longer than that of the longitudinally extending groove 31 is formed on the same while extending from the clamp wall 3*a* to the groove 32*e* corresponding to the V-shaped groove 29 on the selective contact piece 27'. In addition, transversely extending grooves 33 each having a length equal to about one-fourth of that of each selective contact piece are formed on the respective grooves 32*a* to 32*e* at the positions corresponding to one of the piercers 28, e.g., the right-hand one as seen in FIG. 14.

Next, a mode of practical use of the socket constructed in the aforementioned manner will be described below.

First, the selective contact pieces 27 and 27' are fitted into the clamp wall 4*a* of the half A while the piercers 28 are oriented in the upward direction. One lead wire extending from a bulb (not shown) placed on the clamp wall 3*a* through the groove 31 is engaged with the V-shaped groove 29 on the selective contact piece 27 and its foremost end part is bent along the outer wall surface of the selective contact piece 27 and then received in the groove 33, while the other lead wire extending from the same through the groove 30 is engaged with the V-shaped groove 29 on the selective contact piece 27' and its foremost end part is bent along the outer wall surface of the selective contact piece 27' and then received in the groove 33. Thus, there does not arise a malfunction that the lead wires are disengaged from the V-shaped grooves 29.

Subsequently, a flat cable consisting of five cables is placed on the clamping wall 4a of the half A, and thereafter, both the halves A and B are integrated with each other in the face-to-face relationship by folding the half B along the folding portion 2, whereby the piercers 28 on the selective contact pieces 27 and 27' pierce into desired cables, i.e., the cables received in the grooves 32a and 32e to make electrical connection therebetween. At the same time, the bulb and the flat cable are firmly held between both the halves A and B in the clamped state.

Figure 15A:
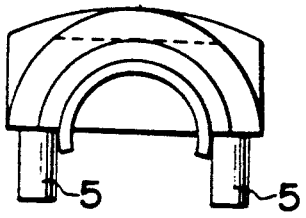
FIG. 15(*a*) is a rear view of a third embodiment of a socket used for the bulb lighting apparatus of the present invention.
Figure 15B:
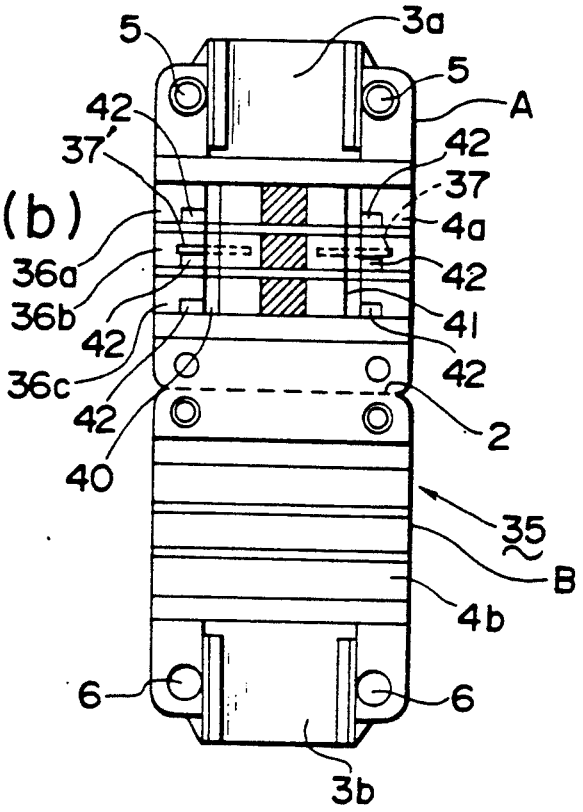
Figure 15C:
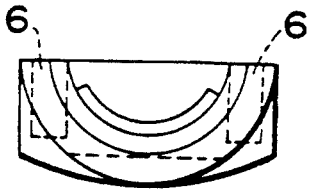
Figure 16:
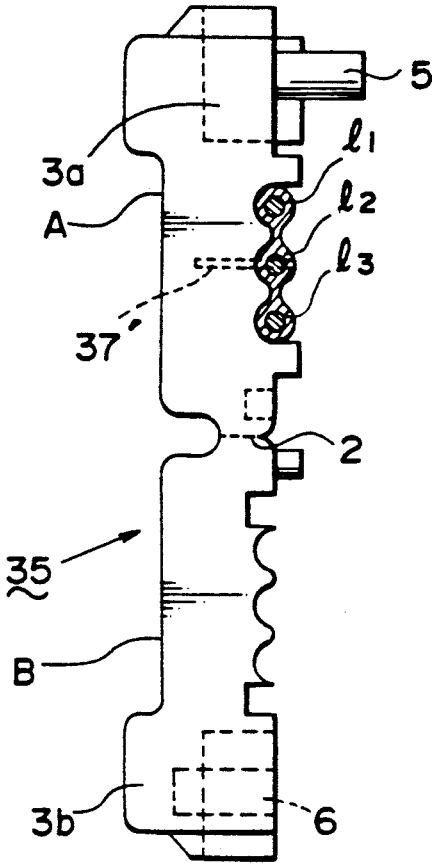
FIG. 16 is a side view of the socket shown in FIGS. 15(*a*), 15(*b*) and FIG. 15(*c*)

Next, FIGS. 15(*a*), 15(*b*) and 15(*c*) shows a socket in accordance with a third embodiment of the present invention wherein the socket is employable for any one of the circuits shown in FIG. 1 to FIG. 4, and FIG. 16 is a side view of the socket shown in FIGS. 15(*b*). A main body 35 of the socket is molded of a flexible elastic synthetic resin and comprises a half A and a half B in the same manner as mentioned above. Same parts and components as those in the preceding embodiments are represented by same reference numerals in FIGS. 15(*a*), 15(*b*), 15(*c*) and FIG. 16.

In this embodiment, clamping walls 4a and 4b are contoured to receive a flat cable consisting of three transversely extending cables therebetween when both the halves A and B are integrated with each other in the face-to-face relationship by folding the half B along a folding portion 2. Specifically, each of the clamping walls 4a and 4b has three grooves 36a, 36b and 36c each having a semicircular sectional shape corresponding to three cables to be received therein. Among the three grooves 36a to 36c, a common cable is received in the groove 36c. A pair of selective contact pieces 37 and 37' are fitted into one of the grooves 36a and 36b. In this embodiment, the selective contact pieces 37 and 37' are fitted into the groove 36b.

Figure 17A:
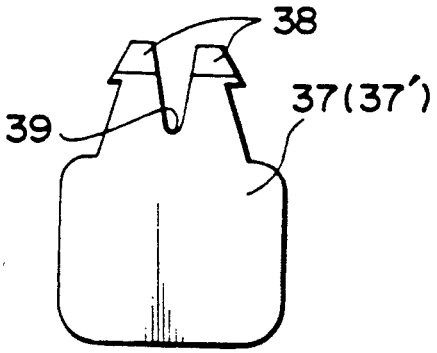
FIG. 17(*a*) is a side view of a selective contact piece for the socket shown in FIGS. 15(*a*), 15(*b*) and 15(*c*) and FIG. 16.
Figure 17B:
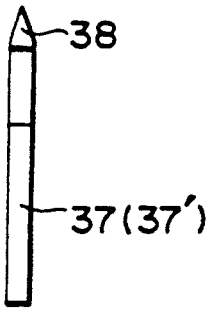

FIGS. 17(*a*) and 17(*b*) show the structure of each of the selective contact pieces 37 and 37'. As is apparent from the drawings, each of the selective contact pieces 37 and 37' is same to that shown in FIG. 14 in material and shape of a V-shaped groove 39 having a semicircular bottom formed between piercers 38 with the exception that its length is dimensioned to be shorter than that of each selective contact piece shown in FIG. 14. A longitudinally extending groove 41 is formed on the clamp wall 4a at the position corresponding to one of piercers 38 (e.g., right-hand one as seen in FIG. 17(*a*)) of the selective contact piece 37 while extending from a clamp wall 3a to the groove 36c, and a longitudinally extending groove 40 is formed on the same at the position corresponding to one of the piercers 38 (e.g., right-hand one as seen in the drawing) of the selective contact piece 37' while extending in the same manner as mentioned above. In addition, transversely extending grooves 42 each having a length equal to about one-fourth of the length of each selective contact piece are formed on the respective grooves 36a to 36c on the clamp wall 4a and adjacent to the selective contact pieces 37 and 37' on the opposite side to the clamp wall 3a.

Next, a mode of practical use of the socket constructed in the aforementioned manner will be described below.

First, a pair of selective contact pieces 37 and 37' are fitted into the groove 36b on the clamp wall 4a of the main body 35 while their piercers 38 are oriented in the upward direction. Thereafter, lead wires extending from a bulb (not shown) placed on the clamp wall 3a are put in the longitudinally extending grooves 40 and 41 so that they are engaged with the V-shaped grooves 39 on the selective contact pieces 37 and 37'. Subsequently, the foremost end parts of the lead wires are bent at a right angle relative to the grooves 40 and 41 while extending along the outer wall surfaces of the selective contact pieces 37 and 37' and then received in the transversely extending grooves 42. Thus, there does not arise a malfunction that the lead wires are disengaged from the grooves 39.

Next, a flat cable consisting of three transversely extending cables is placed on the clamp wall 4a of the half A, and thereafter, both the halves A and B are integrated with each other in the face-to-face relationship by folding the half B along the folding line 2 in the same manner as mentioned above, whereby the piercers 38 on the selective contact pieces 37 and 37' pierce into one of the cables to make electrical connection therebetween while the bulb and the flat cable are firmly clamped between both the halves A and B.

To facilitate understanding of the present invention, the apparatus of the present invention is illustrated in the operative state, i.e., the completely clamped state in FIG. 18 that is a perspective view of the apparatus. Specifically, both halves A and B of a main body 1 are integrated with each other for practical use in the face-to-face relationship by folding the half B along a folding portion 2 so that a flat bundle of cables consisting of a plurality of cables $l_1$, $l_2$,—$l_m$ (five cables in the shown case) and a baseless bulb $P_1$ are firmly held between both the halves A and B in the clamped state.

While the present invention has been described above with respect to several preferred embodiments thereof, it should of course be understood that the present invention should not be limited only to them but various change or modification may be made. For example, after the bulbs are put on a flat cable, the respective bulbs may be molded to the cable by the injection molding. Further, a plurality of controllers may be connected to a DC feed line and a flat cable is connected with each controller. With this structure, a tree type connection of bulbs which branches the plurality of flat cables may be provided. These and other changes and modifications may be made without departure from the scope of the present invention as defined by the appended claims.

What is claimed is:

1. An apparatus for lighting a number of baseless bulbs for the purpose of decoration, comprising:

a flat bundle of cables each sheathed with an electrically insulative synthetic resin and arranged in a spaced relationship while extending in parallel with each other, a plurality of baseless bulbs arranged one after another along at least one cable of said flat bundle of cables while making electrical connection to said at least one cable via lead wires, and a plurality of holding means each serving to firmly hold a respective baseless bulb and said flat bundle of cables so that a central axis of a bulb held by the holding means extends parallel with a plane of said flat bundle of cables and perpendicular to the extending direction of said cables, said plurality of holding means being arranged one after another in the spaced relationship along said flat bundle of cables;

wherein said holding means comprise moldable plastic material; and wherein each of said plurality of holding means is in the form of a socket comprising:

a main body molded of a flexible elastic synthetic resin and comprising a first half and a second half jointed to each other via a folding portion interposed therebetween, said first half and said second half being integrated with each other in a face-to-face relationship by folding said second half along said folding portion when said socket is used, a first clamping wall formed on said first half of said main body for firmly holding a base portion of a baseless bulb in a clamped state when both halves of the main body are integrated with each other for use in the face-to-face relationship, said first clamp wall being contoured to exhibit a semicylindrical shape corresponding to the base portion of said baseless bulb, a second clamp wall formed on said first half for firmly receiving a plurality of transversely extending cables constituting a flat bundle of cables in the clamped state when both halves of the main body are integrated with each other for use in the face-to-face relationship, said second clamping wall being contoured to exhibit a corrugated wall surface consisting of a plurality of transversely extending semicylindrical cable receiving grooves corresponding to said plurality of transversely extending cables, a first clamping wall formed on said second half for firmly holding the base portion of said baseless bulb in the clamped state in cooperation with said first clamp wall on said first half when both halves of the main body are integrated with each other for use in the face-to-face relationship, said first clamp wall being contoured to exhibit a semicylindrical shape corresponding to the base portion of said baseless bulb, a second clamp wall formed on said second half for firmly receiving said plurality of transversely extending cables constituting said flat bundle of cables in the clamped state in cooperation with said second clamp wall on said first half when both halves of the main body are integrated with each other for use in the face-to-face relationship, said second clamp wall being contoured to exhibit a corrugated wall surface consisting of a plurality of transversely extending semicylindrical cable receiving grooves corresponding to said plurality of transversely extending cables, and at least two selective contact pieces fitted into said first clamp wall formed on said first half for firmly receiving said transversely extending cables in the clamped state while extending at a right angle relative to said transversely extending cables, a first one of said selective contact pieces being electrically connected to one of lead wires extending from said baseless bulb by receiving the lead wire in a V-shaped groove formed on a projected part of said first selective contact piece, and moreover, electrically connected to one cable selected from said plurality of transversely extending cables via a piercer projecting from said first selective contact piece and pierced into said selected cable, a second one of said selective contact pieces having a length different from that of the first selective contact piece and being electrically connected to the other lead wire extending from said baseless bulb by receiving said other lead wire in a V-shaped groove formed on a projected part of said second selective contact piece, and moreover, electrically connected to another cable selected from said plurality of transversely extending cables via a piercer projecting from said second selective contact piece and pierced into said selected other cable.

2. The apparatus according to claim 1, wherein small column-shaped projections are caused to stand upright on said first half and holes are formed in said second half so as to receive said projection when both halves of the main body are integrated with each other for use in the face-to-face relationship.

3. The apparatus according to claim 1 further including projected banks on said second half for retaining the lead wires extending from the baseless bulb, said projected banks serving as lead wire retainers when both halves of the main body are integrated with each other for use in the face-to-face relationship.

4. The apparatus according to claim 1 further including a restrictive wall on said second half for restrictively determining the position where the baseless bulb is firmly held in the clamped state when both halves of the main body are integrated with each other for use in the face-to-face relationship.

5. An apparatus for lighting a number of baseless bulbs for the purpose of decoration, comprising:

a flat bundle of cables each sheathed with an electrically insulative synthetic resin and arranged in a spaced relationship while extending in parallel with each other, a plurality of baseless bulbs arranged one after another along at least one cable of said flat bundle or cables while making electrical connection to said at least one cable via lead wires, and a plurality of holding means each serving to firmly hold a respective baseless bulb and said flat bundle of cables so that a central axis of a bulb held by the holding means extends parallel with a plane of said flat bundle of cables and perpendicular to the extending direction of said cables, said plurality of holding means being arranged one after another in the spaced relationship along said flat bundle of cables;

wherein said holding means comprise moldable plastic material; and wherein each of said plurality of holding means is prepared in the form of a socket comprising:

a main body molded of a flexible elastic synthetic resin and comprising a first half and a second half jointed to each other via a folding portion interposed therebetween, said first half and said second half being integrated with each other in the face-to-face relationship by folding said second half along said folding portion when said socket is used, a first clamp wall formed on said first half for firmly holding the base portion of a baseless bulb in the clamped state when both halves of the main body are integrated with each other for use in the face-to-face relationship, said first clamp wall being contoured to exhibit a semicylindrical shape corresponding to the base portion of said baseless bulb, a second clamp wall formed on said first half for firmly receiving a plurality of transversely extending cables constituting a flat bundle of cables in the clamped state when both halves of the main body are integrated with each other for use in the face-to-face relationship, said second clamp wall being contoured to exhibit a corrugated wall surface consisting of a plurality of transversely extending semicylindrical cable receiving grooves corresponding to said plurality of transversely extending cables, a first longitudinally extending groove formed on said first half while extending from said first clamp wall formed for firmly holding the base portion of said baseless bulb to a predetermined position substantially corresponding to one cable selected from said plurality of transversely extending cables, said first longitudinally extending groove serving to allow one of lead wires extending from said baseless bulb to extend therethrough to be electrically connected to said one selected cable, a second longitudinally extending groove having a length different from that of said first longitudinally extending groove and formed on said first half while extending from said first clamp wall formed for firmly holding the base portion of said baseless bulb to a predetermined position substantially corresponding to other cable selected from said plurality of transversely extending cables, said second longitudinally extending groove serving to allow the other lead wire extending from said baseless bulb to extend therethrough to be electrically connected to said other selected cable, a plurality of short transversely extending grooves formed corresponding to said semicylindrical cable receiving grooves so as to allow the foremost end parts of said lead wires to be received therein in the bent state, a first clamp wall formed on said second half for firmly holding the base portion of said baseless bulb in the clamped state in cooperation with said first clamp wall on said first half when both halves of the main body are integrated with each other for use in the face-to-face relationship, said first clamp wall being contoured to exhibit a semicylindrical shape corresponding to the base portion of said baseless bulb, a second clamp wall formed on said second half for firmly receiving said plurality of transversely extending cables constituting said flat bundle of cables in the clamped state in cooperation with said second clamp wall on said first half when both halves of the main body are integrated with each other for use in the face-to-face relationship, said second clamp wall being contoured to exhibit a corrugated wall surface consisting o a plurality of transversely extending semicylindrical cable receiving grooves corresponding to said plurality of transversely extending cables, and at least two selective contact pieces fitted into said first clamp wall formed on said first half for firmly receiving said plurality of transversely extending cables in the clamped state while extending in parallel with said transversely extending semicylindrical cable receiving grooves, a first one of said selective contact pieces being located in one predetermined transversely extending semicylindrical cable receiving groove and electrically connected to one of said lead wires extending from said baseless bulb by receiving said one lead wire in a V-shaped groove formed on a projected part of said first selective contact piece, and moreover, electrically connected to one cable selected from said plurality of transversely extending cables via piercers projecting from said first selective contact piece and pierced into said selected one cable, a second one of the selective contact pieces being located in another predetermined transversely extending semicylindrical cable receiving groove and electrically connected to the other lead wire extending from said baseless bulb by receiving said other lead wire in a V-shaped groove formed on a projected part of the second selective contact piece, and moreover, electrically connected to another cable selected from said plurality of transversely extending cables via piercers projecting from the second selective contact piece and pierced into said selected other cable.

6. The apparatus according to claim 5, wherein small column-shaped projections are caused to stand upright on said first half and holes are formed in said second half so as to receive said projections when both halves of the main body are integrated with each other for use in the face-to-face relationship.

7. An apparatus for lighting a number of baseless bulbs for the purpose of decoration, comprising:

a flat bundle of cables each sheathed with an electrically insulative synthetic resin and arranged in a spaced relationship while extending in parallel with each other, a plurality of baseless bulbs arranged one after another along at least one cable of said flat bundle of cables while making electrical connection to said at least one cable via lead wires, and a plurality of holding means each serving to firmly hold a respective baseless bulb and said flat bundle of cables so that a central axis of a bulb held by the holding means extends parallel with a plane of said flat bundle of cables and perpendicular to the extending direction of said cables, said plurality of holding means being arranged one after another in the spaced relationship along said flat bundle of cables;

wherein said holding means comprise moldable plastic material; and wherein each of said plurality of holding means is prepared in the form of a socket comprising:

a main body molded of a flexible elastic synthetic resin and comprising a first half and a second half jointed to each other via a folding portion interposed therebetween, said first half and said second half being integrated with each other in the face-to-face relationship by folding said second half along said folding portion when said socket is used, a first clamp wall formed on said first half for firmly holding the base portion of a baseless bulb in the clamped state when both halves of the main body are integrated with each other for use in the face-to-face relationship, said first clamp wall being contoured to exhibit a semicylindrical shape corresponding to the base portion of said baseless bulb, a second clamp wall formed on said first half for firmly receiving a plurality of transversely extending cables constituting a flat bundle of cables in the clamped state when both halves of the main body are integrated with each other for use in the face-to-face relationship, said second clamp wall being contoured to exhibit a corrugated wall surface consisting of a plurality of transversely extending semicylindrical cable receiving grooves corresponding to said plurality of transversely extending cables, two longitudinally extending grooves formed on said first half while extending in parallel with each other from said first clamp wall formed for firmly holding the base portion of said baseless bulb to a predetermined position substantially corresponding to the inner end of said corrugated wall surface of said first clamp wall, said longitudinally extending grooves serving to allow lead wires extending from said baseless bulb to extend therethrough to be electrically connected to a predetermined cable selected from said plurality of transversely extending cables, a plurality of short transversely extending grooves formed corresponding to said semicylindrical cable receiving grooves so as to allow the foremost end parts of said lead wires to be received therein in the bent state, a first clamp wall formed on said second half for firmly holding the base portion of said baseless bulb in the clamped state in cooperation with said first clamp wall on said first half when both halves of the main body are integrated with each other for use in the face-to-face relationship, said first clamp wall being contoured to exhibit a semicylindrical shape corresponding to the base portion of said baseless bulb, a second clamping wall formed on said second half for firmly receiving said plurality of transversely extending cables constituting said flat bundle of cables in the clamped state in cooperation with said second clamp wall on said first half when both halves of the main body are integrated with each other for use in the face-to-face relationship, said second clamp wall being contoured to exhibit a corrugated wall surface consisting of a plurality of transversely extending semicylindrical cable receiving grooves corresponding to said plurality of transversely extending cables, and at least two selective contact pieces fitted into said first clamp wall formed on said first half for firmly receiving said plurality of transversely extending cables in the clamped state while extending in parallel with said transversely extending semicylindrical cable receiving grooves, said selective contact pieces being located in a predetermined transversely extending semicylindrical cable receiving groove in alignment with each other in the transverse direction and electrically connected to said lead wires extending from said baseless bulb by receiving them in V-shaped grooves formed on projected parts of said selective contact pieces, and moreover, electrically connected to said predetermined cable via piercers projecting from said selective contact pieces and pierced into said predetermined cable.

8. The apparatus according to claim 7, wherein small column-shaped projection are caused to stand upright on said first half and holes are formed in said second half so as to receive said projections when both halves of the main body are integrated with each other for use in the face-to-face relationship.

* * * * *

UNITED STATES PATENT AND TRADEMARK OFFICE

CERTIFICATE OF CORRECTION

PATENT NO. : 5,330,368

DATED : July 19, 1994

INVENTOR(S) : Masaaki TSURUZONO

It is certified that error appears in the above-indentified patent and that said Letters Patent is hereby corrected as shown below:

On title page,

Item No. 22: "Filed: August 28, 1993" should be —Filed: August 28, 1992—.

Signed and Sealed this

Twenty-seventh Day of September, 1994

*Attest:*

Bruce Lehman

BRUCE LEHMAN

*Attesting Officer*

*Commissioner of Patents and Trademarks*